US005356276A

United States Patent [19]

Spinnler

[11] Patent Number: 5,356,276

[45] Date of Patent: Oct. 18, 1994

[54] SPIRAL DISPLACEMENT MACHINE MADE OF MAGNESIUM ALLOY

[75] Inventor: Fritz Spinnler, Mellingen, Switzerland

[73] Assignee: Aginfor AG fur Industrielle Forschung, Wettingen, Switzerland

[21] Appl. No.: 985,653

[22] Filed: Dec. 7, 1992

[30] Foreign Application Priority Data

Dec. 5, 1991 [CH] Switzerland ..... 3581/91

[51] Int. Cl.[5] ..... F01C 1/04; F04C 18/04

[52] U.S. Cl. ..... 418/55.2; 418/55.4; 418/60; 418/179

[58] Field of Search ..... 418/55.2, 179, 55.4, 418/142, 60; 29/888.022

[56] References Cited

U.S. PATENT DOCUMENTS

| | | | |
|---|---|---|---|
| 3,500,797 | 3/1970 | Scheufler | 418/179 |
| 3,756,754 | 9/1973 | Sakamaki | 418/179 |

FOREIGN PATENT DOCUMENTS

| | | | |
|---|---|---|---|
| 0354342 | 2/1990 | European Pat. Off. . | |
| 2603462 | 8/1976 | Fed. Rep. of Germany . | |
| 1-12090 | 1/1989 | Japan | 418/55.2 |
| 1155001 | 6/1989 | Japan | 418/55.2 |
| 3242486 | 10/1991 | Japan | 418/55.2 |
| 278382 | 12/1927 | United Kingdom | 418/179 |

OTHER PUBLICATIONS

Development of Volkswagen's Supercharger G-Lader, B. Wiedemann, H. Leptien, G. Stolle, K.-D. Emmenthal, Volkswagen AG Wolfsburg, International Congress and Exposition Detroit, Michigan, Feb. 24–28, 1986.

*Primary Examiner*—John J. Vrablik

*Attorney, Agent, or Firm*—Oblon, Spivak, McClelland, Maier & Neustadt

[57] ABSTRACT

A displacement machine for compressible mediums has several spiral-shaped conveying spaces (11*a*, 11*b*), which are disposed in a stationary housing lead from an inlet (12*a*, 12*b*), which lies radially on the outside, to an outlet (13), which lies radially on the inside. A displacement body, which is assigned to the conveying spaces has a disk (2) with spiral-shaped strips (3*a*, 3*b*) arranged perpendicularly on both sides. This displacement body, driven off-centered, is made of a magnesium alloy. During service, each of its points effects a circular movement defined by the circumferential walls of the conveying space. The ribs (45, 46) bordering the conveying spaces (11*a*, 11*b*) in the housing are made as one piece with the housing and the entire housing is made of the same or similar magnesium-based alloy as the displacement body (2, 3, 4, 5).

3 Claims, 2 Drawing Sheets

SPIRAL DISPLACEMENT MACHINE MADE OF MAGNESIUM ALLOY

BACKGROUND OF THE INVENTION

1. Field of the Invention

The invention relates to displacement machines for compressible mediums, with several spiral-shaped conveying spaces which are disposed in a stationary housing and which lead from an inlet lying radially on the outside, to an outlet lying radially on the inside. A displacement body which is assigned to the conveying spaces, comprises a disk with spiral-shaped strips arranged perpendicularly on both sides. The displacement body, driven off-centered, is made of a magnesium alloy, and during service each of its points affects a circular movement defined by the circumferential walls of the conveying space.

2. Discussion of the Background

Displacement machines of the spiral design are known from DE-C-26 03 462. A compressor built according to this principle provides an almost pulsation free conveying of the gaseous working medium, which consists of, for example, air or a mixture of air and fuel. It could also be used advantageously for charging internal combustion engines. While such a compressor is operating, several crescent-shaped working spaces, which move from the inlet through the displacement chamber to the outlet, are enveloped along the displacement chamber between the spiral-shaped displacement body and the two circumferential walls of the displacement chamber.

A machine of the aforementioned type is known from the EP-A-0 354 342. To better utilize the volume of the machine, the trend of development is in the direction of higher pressure ratios and higher speeds. The former causes steeper temperature gradients in the disk; the latter leads to greater inertial forces. Therefore, the displacement body is made preferably of a light metal alloy, for example magnesium. Thus, the inertial forces acting on the main eccentric bearing can be minimized. The two halves of the housing of such a machine are usually made of an inexpensive aluminum die casting. With suitable rigid construction of the drive shaft and the bearing part of the rotor, this pairing of the material the spiral walls of the displacement body and the housing ribs can permit touch contact in the circumferential direction of the spiral. The materials wear to produce zero play without galling of one of the elements involved. The result is a greater tolerance owing to the mechanical treatment of the elements and higher operating temperatures of the machine during service.

SUMMARY OF THE INVENTION

It is an object of the invention to continue to make use of the advantages of magnesium alloys, such as weight, friction properties and the like, despite the fact that when such a machine is mass produced, it is necessary to separate the aluminum machining from the magnesium machining, a feature that leads to increased costs.

A further object of the invention is to provide a displacement machine of the aforementioned kind, in which the same starting materials can be used for the parts that are operatively connected.

The above objects are satisfied by making at least the walls forming the conveying spaces in the circumferential direction of the spirals of a magnesium alloy. For example, only the walls forming the conveying spaces in the circumferential direction of the spirals may be formed of a magnesium alloy.

The advantage of the invention lies in the fact that, if the rotor and housing make contact, one does not have to dispense with the widen-by-wear capability of the material used. For example, this would not be the case for an aluminum rotor.

It is especially expedient that the conveying spaces disposed in the housing and the ribs bordering them be made as one piece with the housing and that the entire housing is made of a magnesium alloy. The most voluminous parts of a spiral machine are the housing halves; they form the predominant portion of the weight. Since the displacement machine becomes significantly lighter due to the invention, it is also possible to use lighter bracings at the site of installation. If this installation site is, for example, an internal combustion engine to be charged, the lighter design has an especially advantageous effect on the vibration behavior of the whole system.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

For the purpose of explaining the method by which the compressor functions, which is not the subject matter of the invention, reference is made to DE-C3-2 603 462 that has already been cited. In the following, only the construction of the machine and process that are necessary for understanding are described briefly.

Figure 1:
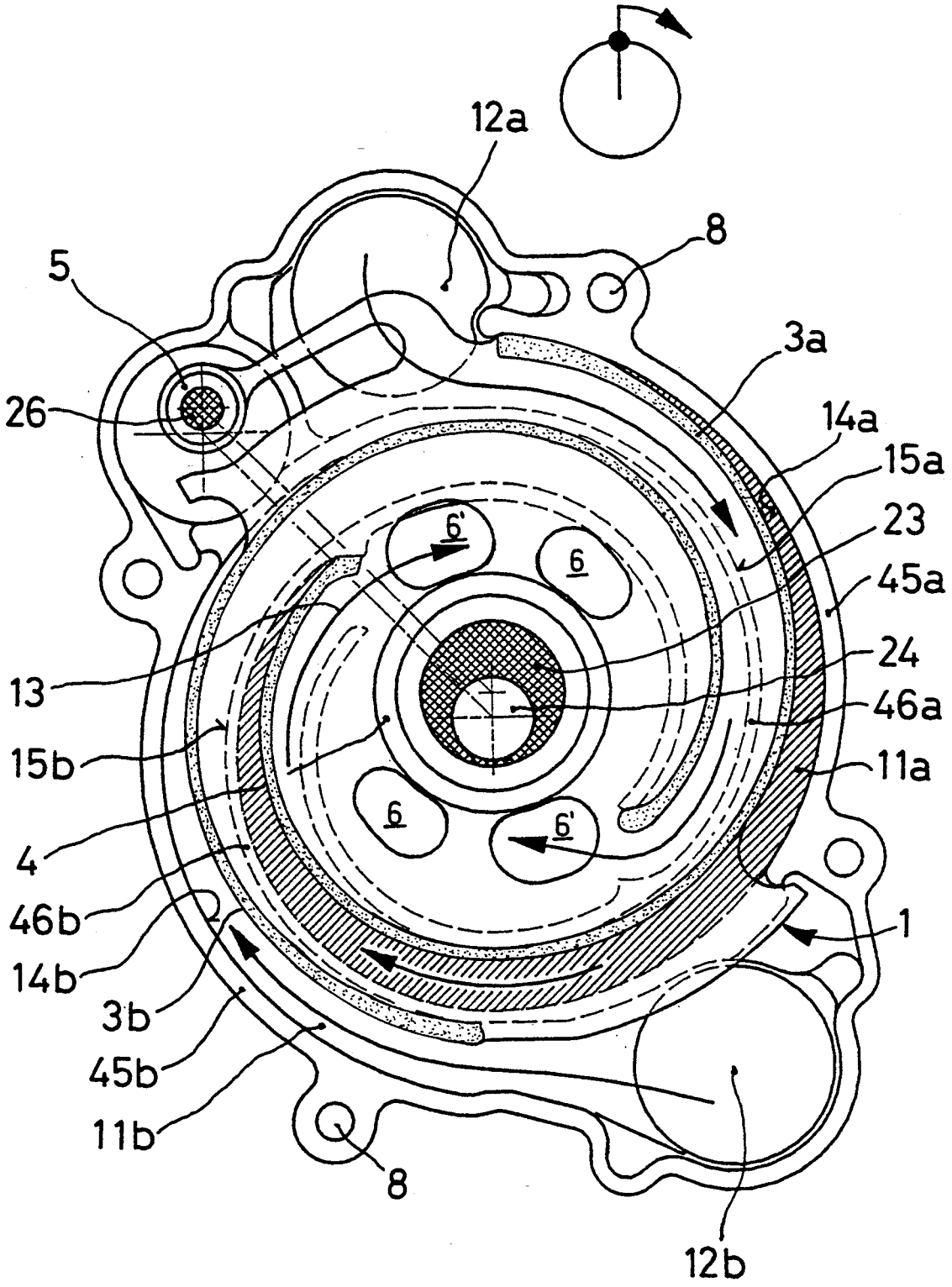
FIG. 1 is a cross sectional view of the drive-side housing section of the displacement machine along line I—I in FIG. 2.
Figure 2:
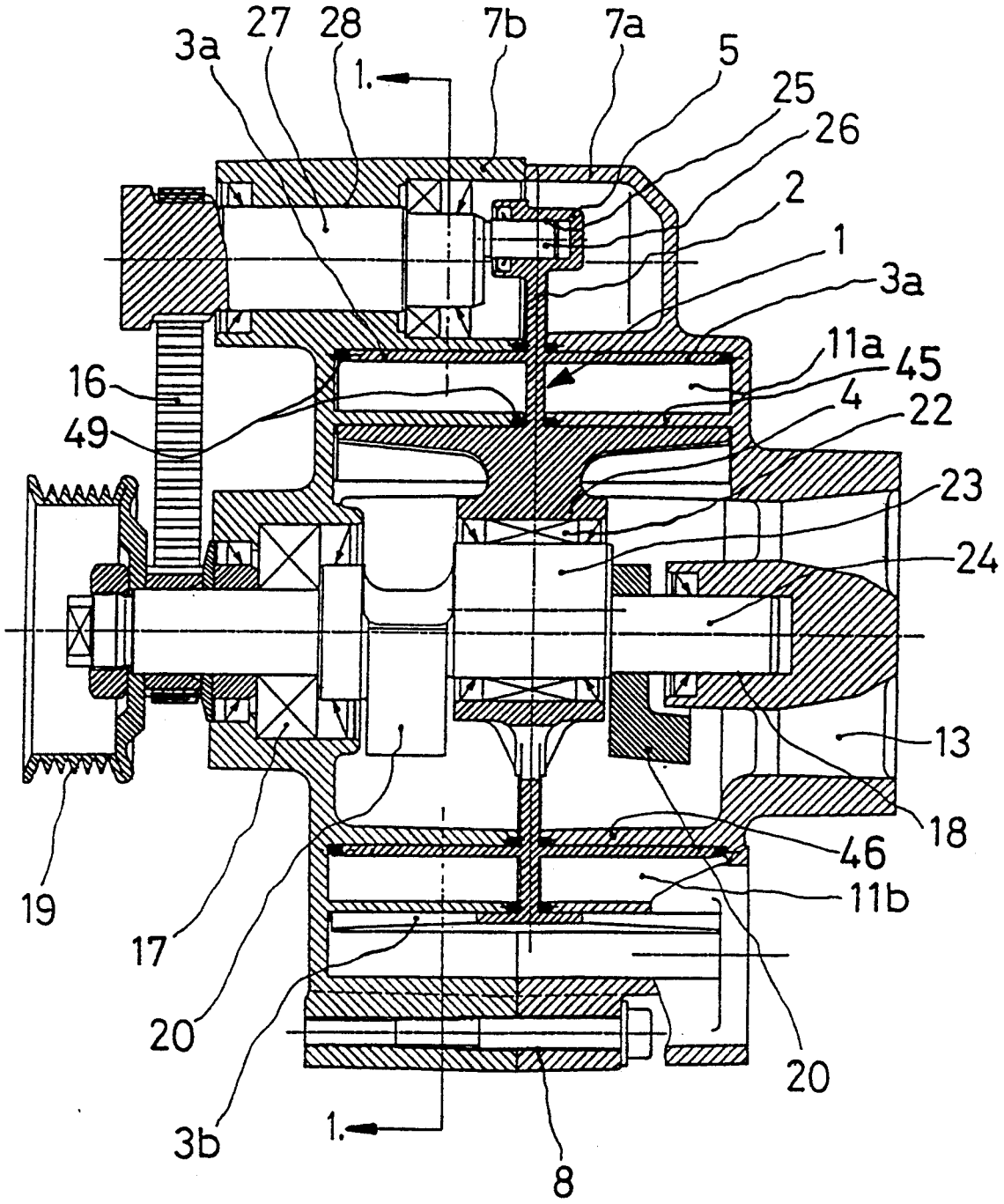
FIG. 2 is a longitudinal sectional view of the displacement machine.

FIG. 1 shows the housing with the conveying spaces and the inserted rotor or displacement body 1. Two spiral-shaped strips 3*a*, 3*b* are attached to both sides of the disk 2. Strips 3*a*, 3*b* extend perpendicularly on the disk 2. In the example shown, the spirals themselves comprise several adjoining circular arcs. A hub 4 of the disk 2 is mounted to the eccentric disk 23 via a roller bearing 22 (FIG. 2). This disk 23 is in turn a part of the main shaft 24.

An eye 5, which is arranged radially outside the strips 3*a*, 3*b* has a guide bearing 25 which is slipped on an eccentric bolt 26 which is a part of a guide shaft 27. The spiral end has four passage windows 6, 6' in the disk so that the medium can flow from one side of the disk to the other in order to be drawn off in a central outlet 13 (FIG. 2) arranged on only on side.

Elements 2, 3*a*, 3*b*, 4 and 5 are made as one piece of a magnesium alloy.

The machine housing comprises two halves 7*a*, 7*b* connected together by way of attachment eyes 8 to accommodate threaded joints. Two conveying spaces 11*a* and 11*b*, which are offset by 180° , are machined like spiral-shaped slots into the two halves of the housing. They extend from one inlet each 12*a*, 12*b*, which is arranged on the outer circumference of the spiral in the housing, to the outlet 13 which is provided within the housing and is common to both conveying spaces. They have essentially parallel cylinder walls 14*a*, 14*b*, 15*a*, 15*b*, which are spaced equidistant apart and, like the displacement bodies of the disk 2, enclose a spiral of 360°. Between these cylinder walls extend the strips 3*a*, 3*b*, whose curvature is dimensioned in such a manner that the strips almost touch the inner and outer cylinder walls of the housing at several points, for example at two points simultaneously. Seals 49 in suitable grooves are embedded on the free faces of the strips 3*a*, 3*b* and the ribs 45, 46. Due to the seals, the working spaces are sealed relative to the side walls of the housing and the displacement body, respectively.

According to the invention, in the example shown the two halves 7*a* and 7*b* of the housing and the ribs 45 and 46 forming the conveying spaces 11*a* and 11*b* are also made of a magnesium alloy, which does not necessarily have to be the same as that of the displacement body.

The two parts can be a cast or forged. The kind of production advantages that can be expected are that now displacement and housing can be machined on the same milling machine; during the cutting operation of the magnesium the milling tools have a significantly higher service life than during the cutting of aluminum; the magnesium cutting requires less energy; and as a consequence of the lower consumption of energy the metal-cutting machine needs a small drive unit.

The drive and guiding of the rotor 1 are provided for by the two spaced eccentric arrangements 23, 24, and 26, 27 respectively. The main shaft 24 is mounted in a roller bearing 17 and a sliding bearing 18. On its end projecting beyond the housing half 7*b* the shaft is provided with a V-belt pulley 19 for the drive. Counterweights 20 are attached to the shaft in order to compensate for the force due to inertia produced during the eccentric drive of the rotor. The guide shaft 27 is held within the housing half 7*b* in a sliding bearing 28.

In order to obtain a definite guide of the rotor at the dead point positions, the two eccentric arrangements are synchronized conformably. This is done by way of a toothed belt drive 16. When in service, the double eccentric drive provides that all of the points of the rotor disk and thus also all of the points of both strips 3*a*, 3*b* effect a circular displacement movement. As a consequence of the strips 3*a*, 3*b* approaching repeatedly and alternatingly the inner and outer cylinder walls of the related conveying chambers, whereby a direct mutual contact is harmless as a consequence of the materials used, crescent-shaped working spaces enclose the working medium and are displaced during the drive of the rotor disk through the conveying chambers in the direction of the outlet, on both sides of the strips. At the same time the volumes of the working spaces decrease and the pressure of the working medium is correspondingly increased.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A displacement machine for compressible media, comprising:

a stationary housing having circumferentially extending spiral walls, a radially outer inlet and a radially inner outlet;

a displacement body in said housing, said displacement body comprising a disk having spiral shaped strips extending perpendicularly from opposite sides of the disk, wherein said spiral strips have axial seals and cooperate with the walls of the housing to define spiral shaped conveying spaces in said housing; and means for eccentrically driving said displacement body such that said displacement body effects a circular movement with said conveying spaces moving from the inlet to the outlet, wherein said displacement body is made of magnesium alloy and at least the circumferentially extending housing walls are made of a magnesium alloy, so that circumferentially extending walls of said conveying spaces are formed of a magnesium alloy.

2. The machine of claim 1 wherein said housing is formed of a magnesium alloy.

3. The machine of claim 2 wherein said housing walls are formed unitarily with a remainder of said housing.

* * * * *